US009742097B2

(12) United States Patent
Suzuki

(10) Patent No.: US 9,742,097 B2
(45) Date of Patent: Aug. 22, 2017

(54) FLUIDPROOF CONNECTOR

(71) Applicant: Sumitomo Wiring Systems, Ltd., Yokkaichi, Mie (JP)

(72) Inventor: Masakazu Suzuki, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/276,998

(22) Filed: Sep. 27, 2016

(65) Prior Publication Data

US 2017/0098906 A1 Apr. 6, 2017

(30) Foreign Application Priority Data

Oct. 5, 2015 (JP) ..... 2015-197484

(51) Int. Cl.
*H01R 13/52* (2006.01)

(52) U.S. Cl.
CPC ..... *H01R 13/52* (2013.01)

(58) Field of Classification Search
CPC ..... H01R 13/5221; H01R 13/5208; H01R 13/5213; H01R 13/521
USPC ..... 439/274, 275, 587, 588, 589
See application file for complete search history.

(56) References Cited

U.S. PATENT DOCUMENTS 5,915,990 A * 6/1999 Beer ..... H01R 12/675 439/404
5,997,320 A * 12/1999 DeMello ..... B60D 1/64 439/148
6,203,344 B1 * 3/2001 Ito ..... H01R 27/00 439/218
6,309,848 B1 * 10/2001 Howett ..... A01K 67/0271 424/9.1

FOREIGN PATENT DOCUMENTS

JP 2009-170233 7/2009

* cited by examiner

*Primary Examiner* — Phuongchi T Nguyen
(74) *Attorney, Agent, or Firm* — Gerald E. Hespos; Michael J. Porco; Matthew T. Hespos

(57) ABSTRACT

A waterproof connector includes a housing (10) provided with cavities (11) capable of accommodating terminal fittings (T) and open backward, a dummy plug (30) configured to be held in close contact with an inner surface of the cavity (11) by being inserted into the cavity (11) from behind, tapered surfaces (18) formed on a rear surface of the housing (10) to surround openings (16) of the cavities (11) and inclined to come closer to the inner surfaces (17) of the cavities (11) toward the back, and a pressing portion (32) provided on the dummy plug (30) and configured to be pressed against the tapered surface (18) by a forward force acting on the dummy plug (30).

9 Claims, 4 Drawing Sheets

FLUIDPROOF CONNECTOR

BACKGROUND

1. Field of the Invention

The invention relates to a fluidproof connector.

2. Related Art

A conventional waterproof connector has a housing with cavities to accommodate terminal fittings that are connected to ends of wires. Openings of the cavities are closed by waterproof rubber plugs fit on end parts of wires. A dummy plug may be used instead of the waterproof rubber plug to close a cavity left empty without having a terminal fitting inserted therein.

Japanese Unexamined Patent Publication No. 2009-170233 discloses a waterproof connector with a dummy plug that is fit into an empty cavity. The dummy plug has a cylindrical main body and lips on the outer peripheral surface of the main body. The dummy plug is deformed entirely in a diameter reducing direction when being pushed into the cavity, thereby being held in close contact with the inner surface of the cavity over the entire circumference. However, the dummy plug may move back due to a high water pressure if the connector is exposed, for example, to washing water or the like injected at a high pressure. Movement of the dummy plug toward the back of the cavity can adversely affect sealing. Thus, measures against this movement have been desired.

The invention was completed based on the above situation and aims to prevent a dummy plug from being pushed toward a back side of a cavity in a fluidproof connector.

SUMMARY

According to one aspect of the invention, there is provided a fluid- or waterproof connector with a housing that at least one rearwardly open cavity configured for at least partly accommodating at least one terminal fitting. At least one dummy plug inserted into the cavity in an insertion direction and is configured to be held in close contact with an inner surface of the cavity. At least one tapered surface is formed on a rear surface of the housing to surround an opening of the respective cavity and is inclined to come closer to the inner surfaces of the cavity toward the back. A pressing portion is provided on the dummy plug and is configured to be pressed against the tapered surface by a forward force acting on the dummy plug. The pressing portion can be pressed against the tapered surface to limit a forward movement of the dummy plug. Thus, the dummy plug can be prevented from being pushed toward a back side of the cavity.

The pressing portion may include a pressing surface to be held in surface contact with the tapered surface. The widened contact surface of the pressing portion and the tapered surface provides a larger surface contact are that closes a fluid or water intrusion path more effectively.

The pressing portion may include at least one pressing projection to be held in contact with the tapered surface. Thus, the pressing projection is squeezed and held in close contact with the tapered surface, thereby closing a water intrusion path.

The dummy plug may include a hook configured to hook a removing tool. Thus, a wiring harness assembling operation can be performed easily since the dummy plug can be pulled out easily if it is inserted erroneously into a cavity.

The dummy plug may include a main body to be accommodated at least partly into the cavity. The main body may have an outer shape substantially in conformity with a cross-sectional shape of a sealing surface of the cavity.

The dummy plug may include one or more lips are on the outer peripheral surface thereof to interact with a sealing surface of the cavity.

The pressing portion may be provided on a jaw or flange at or near a rear end of the dummy plug.

The jaw may project radially out farther than the main body and may project continuously from the main body over the substantially entire circumference. Note that the jaw may project farther out than the lips.

These and other objects, features and advantages of the invention will become more apparent upon reading the following detailed description of preferred embodiments and accompanying drawings. It should be understood that even though embodiments are described separately, single features thereof may be combined to additional embodiments.

DETAILED DESCRIPTION

Figure 1:
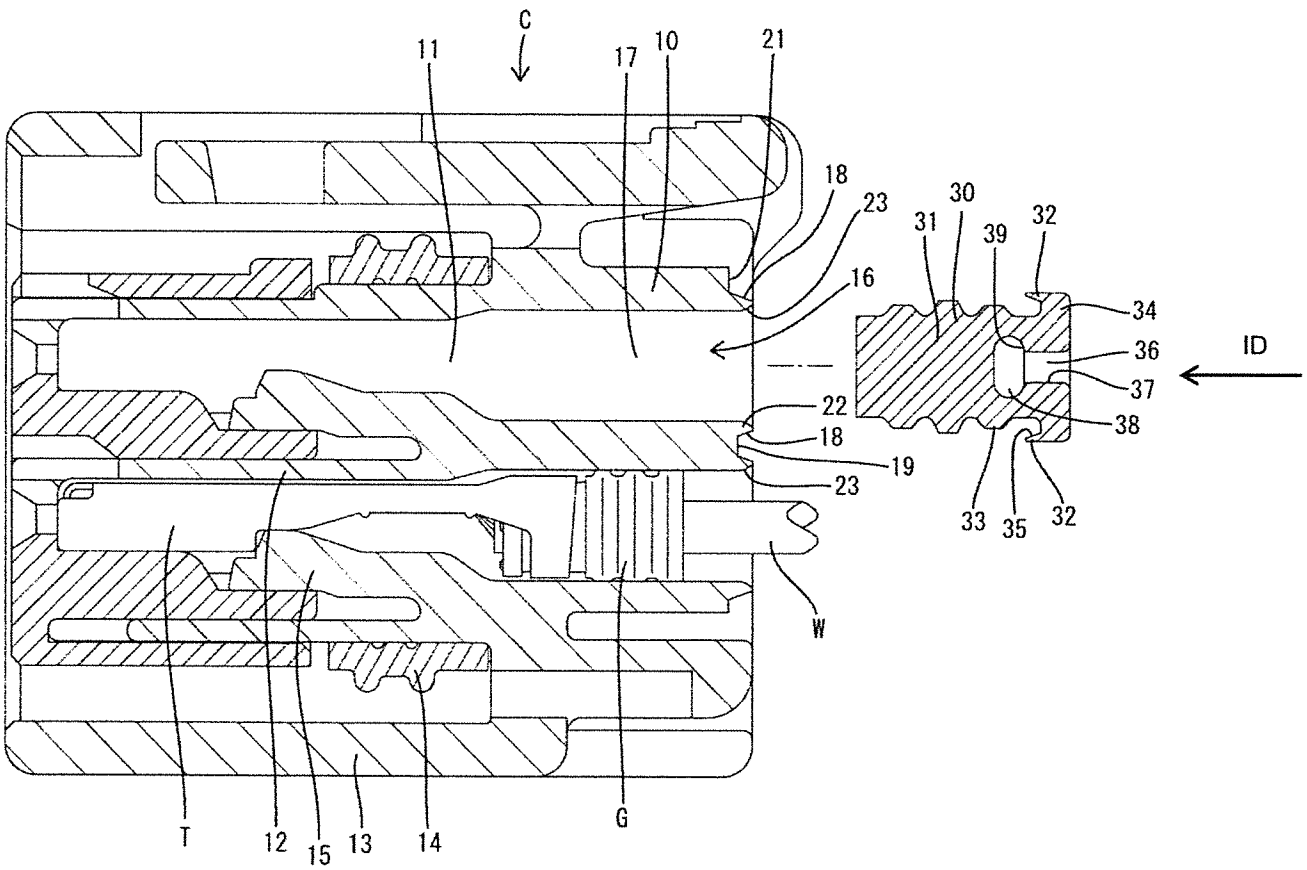
FIG. 1 is a section showing a waterproof connector in a first embodiment in a state before a dummy plug is fit.
Figure 2:
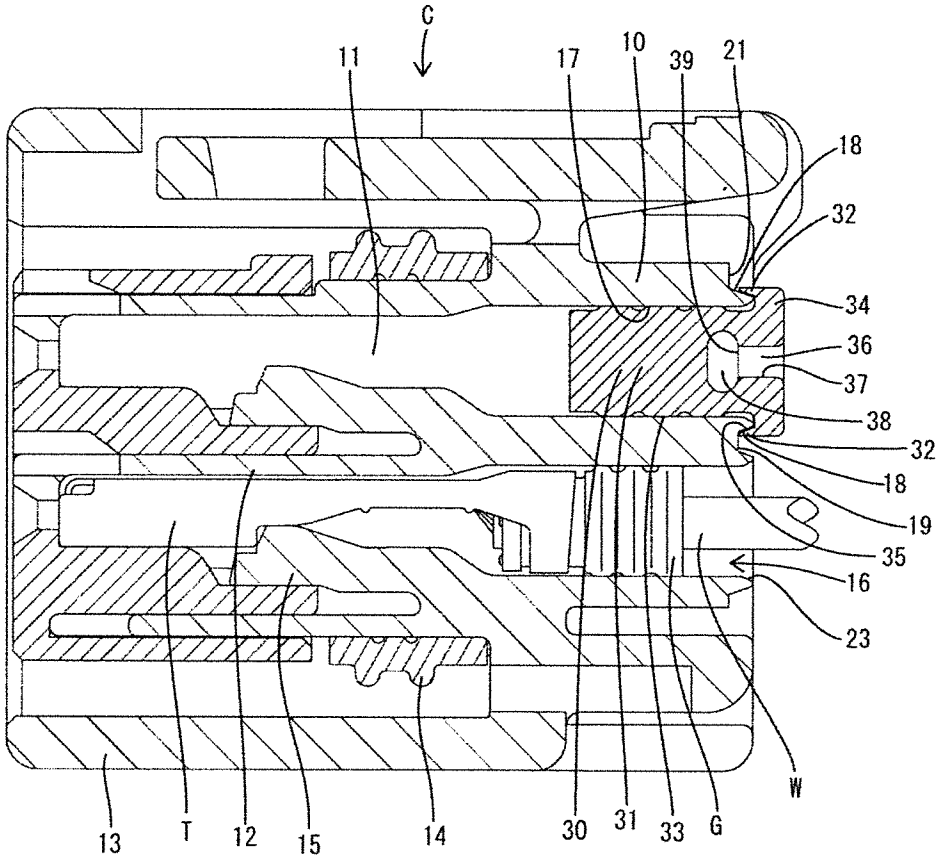
FIG. 2 is a section showing the waterproof connector in a state where the dummy plug is fit.
Figure 3:
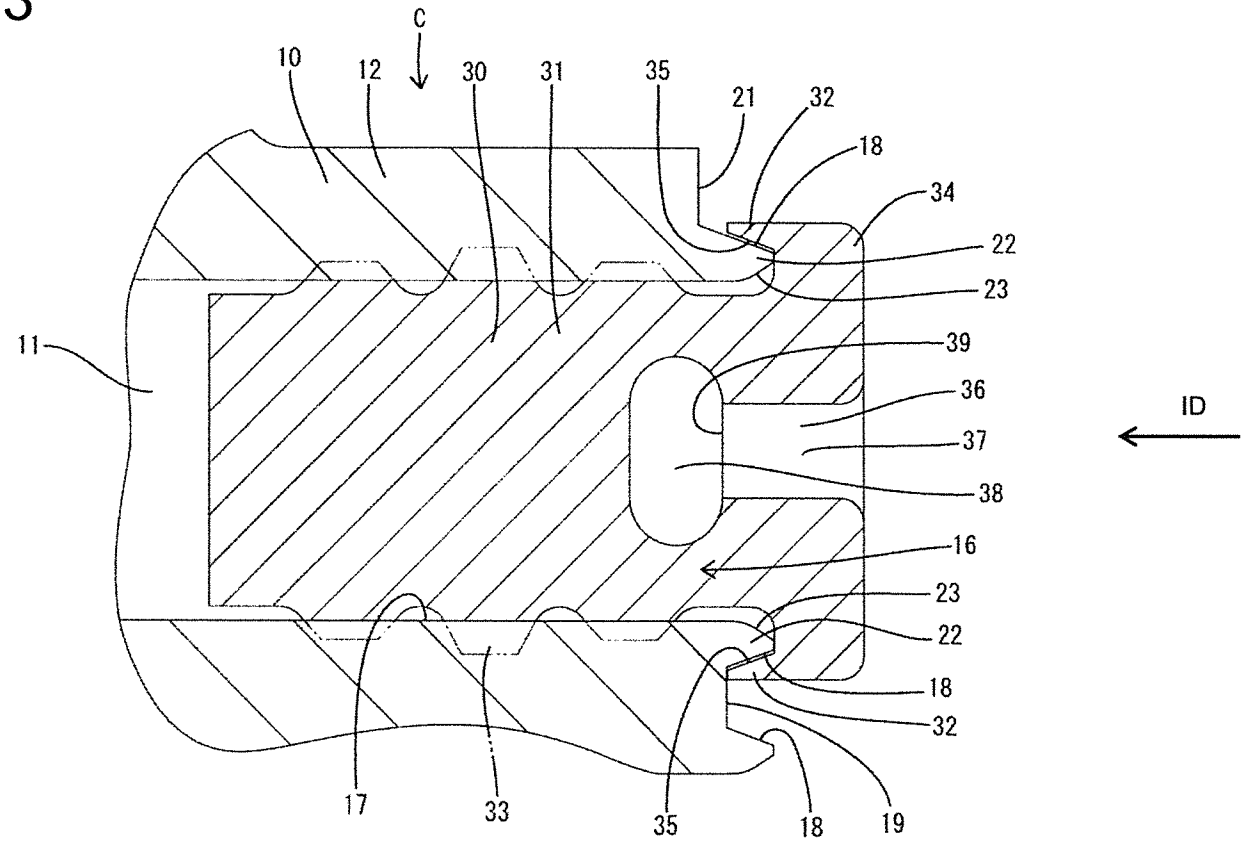
FIG. 3 is a partial enlarged section showing the dummy plug fit into the waterproof connector.

A fluid- or waterproof connector according to a first embodiment of the invention is identified by the letter C in FIGS. 1 to 3. The connector C includes a housing 10 with cavities 11 capable of accommodating terminal fittings T and a dummy plug 30 to be inserted into at least one of the cavities 11 that has no terminal fitting T accommodated therein. In the following description, an inserting direction ID of the dummy plug 30 into the housing 10 is referred to as a forward direction, an opposite direction is referred to as a backward direction and upper and lower sides of FIG. 1 are referred to as upper and lower sides.

The housing 10 is made e.g. of synthetic resin and includes a terminal accommodating portion 12 provided with cavities 11 and an outer tube 13 at least partly surrounding the outer periphery of the terminal accommodating portion 12. An annular fluid- or waterproof seal 14 is to be provided between the terminal accommodating portion 12 and the outer tube portion 13 for sealing between the housing 10 and an unillustrated mating housing.

The cavities 11 are juxtaposed in vertical and lateral directions in the terminal accommodating portion 12. Each cavity 11 is open backward and the terminal fitting T fixed to an end part of a wire W is inserted through an opening 16 on the rear end of the cavity 11. Each cavity 11 is provided with a locking lance 15 for retaining the terminal fitting T by locking the inserted terminal fitting T.

A rear part of each cavity 11 is formed into a sealing surface 17 which can be held in close contact with a fluid- or waterproof rubber plug G or the dummy plug 30. The sealing surface 17 has a circular cross-section. When the terminal fitting T is accommodated into the cavity 11, the waterproof rubber plug G on the end part of the wire W is held tightly in close contact with the sealing surface 17 to seal the opening 16 of the cavity 11.

Tapered surfaces 18 are formed on the rear surface of the housing 10 to surround the opening 16 of each cavity 11. The tapered surfaces 18 are provided to individually surround the openings 16 of all the cavities 11 in the housing 10. The tapered surface 18 has an annular shape continuous over the entire circumference along the opening 16 of each cavity 11 when viewed from the sealing side or behind.

The tapered surface 18 is inclined to come closer to the sealing surface (inner surface) 17 of the cavity 11 toward the back, i.e. inclined to spread gradually outwardly in a radial direction of the cavity 11 toward the front. The tapered surface 18 is at an acute angle to an axis of the cavity 11. A gradient of the tapered surface 18 is constant over the entire circumference.

Parts of the tapered surfaces 18 located between the cavities 11 adjacent in the vertical direction have a shorter length in a front-back direction than parts located at outer sides (upper side of the upper cavity 11 and lower side of the lower cavity 11). In other words, the parts of the tapered surfaces 18 located between the adjacent cavities 11 have a shorter length than parts located at sides of the cavities 11 not being arranged adjacent to a neighboring cavity 11. Further, a center or intermediate recess 19 is formed between the adjacent (e.g. upper and lower) tapered surfaces 18 between the cavities 11 adjacent in the vertical direction. Further, end recesses 21 are formed at outer sides of the tapered surfaces 18 at the upper side of the upper cavity 11 and the lower side of the lower cavity 11. The end recesses 21 are deeper (have a longer dimension in the front-back direction) than the center or intermediate recess 19.

A rearwardly projecting substantially annular tubular portion 22 is formed between the sealing surface 17 of each cavity 11 and the tapered surface 18 surrounding each respective cavity 11. The tubular portion 22 surrounds the opening 16 of each cavity 11. A guiding portion 23 for guiding the waterproof rubber plug G or the dummy plug 30 into the cavity 11 is formed on the inner surface of the tubular portion 22. The guiding portion 23 is inclined radially inwardly toward the front from the rear end of the tubular portion 22 (rear end of the cavity 11). Note that the guiding portion 23 has a shorter length in the front-back direction than the tapered surface 18.

The dummy plug 30 is made of a rubber material (as a particular resilient material) such as silicone and held in close contact with the sealing surface 17 when being inserted into the cavity 11. The dummy plug 30 includes a main body 31 to be accommodated into the cavity 11 and a pressing portion 32 to be pressed against the tapered surface 18.

The main body 31 has a cylindrical shape substantially in conformity with a cross-sectional shape of the sealing surface 17. Three lips 33 are provided on the outer peripheral surface of the main body 31. The lips 33 are continuously provided over the entire circumference of the main body 31 and project radially outwardly from the main body 31.

The pressing portion 32 is provided on a jaw 34 provided on a rear side of the main body portion 31. The jaw 34 projects radially out farther than the main body 31. The jaw 34 has a radial dimension one size larger than that of the main body 31 and continuously projects from the main body 31 over the entire circumference. Note that the jaw 34 projects farther out than the lips 33.

The pressing portion 32 projects forward on a radial outer end part of the jaw 34. The pressing portion 32 is formed continuously over the entire circumference of the jaw 34. A projecting dimension of the pressing portion 32 from the jaw 34 is equal to a recessed dimension of the center recess 19.

The pressing portion 32 has a pressing surface 35 to be held in surface contact with the tapered surface 18. The pressing surface 35 is inclined radially out toward the front. The pressing surface 35 is formed on a radially inner side of the pressing portion 32 and is formed to be inclined at a constant gradient (equal to that of the tapered surface 18) over at least part of the circumference, particularly over the entire circumference of the pressing portion 32. The pressing surface 35 is formed on the entire inner peripheral surface of the pressing portion 32. Note that the outer peripheral surface of the pressing portion 32 is substantially parallel to the front-back direction.

A rear part of the dummy plug 30 includes a rearwardly open forwardly closed hook 36 that is configured to hook an unillustrated removing tool. The hook 36 is provided in a radial central part of the dummy plug 30.

The hook 36 includes a hole 37 open along a center axis of the dummy plug 30 from the rear end of the dummy plug 30 and a wide portion 38 that communicates with a front side of the hole 37. The wide portion 38 is expands more radially out than the hole 37. The wide portion 38 has a width (radial dimension) slightly larger than the hole 37 and expands farther out than the hole 37 over the entire circumference. The hole 37 penetrates through the jaw 34 and the wide portion 38 is formed in the main body 31.

The rear surface of the wide portion 38 defines a locking surface 39 to which removing portion (such as a tip part) of the removing tool is lockable. The locking surface 39 is substantially at a right angle to the front-back direction, and is formed over the entire circumference of the wide portion 38.

Next, an example of an operation of inserting the dummy plug 30 into the cavity 11 in the waterproof connector C of this first embodiment is described.

The main body 31 of the dummy plug 30 is pushed into the cavity 11 through the opening 16 in the inserting direction ID e.g. from front. The lips 33 having entered the cavity 11 are resiliently squeezed and held in close contact with the sealing surface 17 and the tubular portion 22 is inserted between the pressing portion 32 and the main body 31 of the dummy plug 30.

When the main body 31 is accommodated entirely into the cavity 11, the rear end of the tubular portion 22 butts against the front surface of the jaw 34 and the pressing surface 35 of the pressing portion 32 is held proximate to and along the tapered surface 18. In this way, the dummy plug 30 is positioned. All of the lips 33 of the dummy plug 30 are held in close contact with the sealing surface 17 to seal the cavity 11. In this way, the operation of inserting the dummy plug 30 into the cavity 11 is completed.

The dummy plug 30 erroneously could be inserted into the cavity 11 planned to have the terminal fitting T accommodated therein. In this situation, the dummy plug 30 needs to be removed. The dummy plug 30 of the invention can be removed easily by using the removing tool. Specifically, the removing tool is inserted into the hook 36, and the tip part of the removing tool is hooked to the locking surface 39. The removing tool then is pulled backward (in a direction substantially opposite to the inserting direction ID) so that the dummy plug 30 can be removed rearward from the cavity 11. Since the hook 36 is open rearward at a position located more backward than the rear surface of the housing 10, the removing tool can be inserted easily.

The waterproof connector C may be placed in an environment to be subjected to a high water or fluid pressure such as during high-pressure washing. In this case, if the high water or fluid pressure acts on the rear surface of the dummy plug 30 and the dummy plug 30 is pushed forward, the pressing portion 32 is pressed against the tapered surface 18 to limit a forward movement of the dummy plug 30. Thus, the dummy plug 30 is prevented from moving toward a front end of the cavity 11. Further, since the entire pressing surface 35 is pressed against and held in close contact with the tapered surface 18, water intrusion between the pressing portion 32 and the tapered surface 18 is prevented.

Next, functions and effects of the first embodiment configured as described above are described.

The waterproof connector C of this first embodiment includes the housing 10 provided with the cavities 11 capable of accommodating the terminal fittings T and open backward and the dummy plug 30 to be held in close contact with the sealing surface 17 of the cavity 11 by being inserted into the cavity 11 in the inserting direction ID, e.g. from behind. The tapered surface 18 inclined to come closer to the sealing surface 17 of the cavity 11 toward the back is formed on the rear surface of the housing 10 to surround the opening 16 of the cavity 11, and the dummy plug 30 is provided with the pressing portion 32 to be pressed against the tapered surface 18 by a forward force acting on the dummy plug 30.

According to this configuration, even if a high fluid pressure acts on the dummy plug 30, the pressing portion 32 of the dummy plug 30 is pressed against the tapered surface 18, thereby limiting a forward movement (i.e. movement in the inserting direction ID) of the dummy plug 30. Thus, the dummy plug 30 can be prevented from being pushed toward the back side (left side as shown) of the cavity 11.

Further, the pressing portion 32 includes the pressing surface 35 to be held in surface contact with the tapered surface 18. According to this configuration, a fluid or water intrusion path can be closed since a contact surface of the pressing portion 32 and the tapered surface 18 is widened and enlarged.

Further, the dummy plug 30 includes the hook 36 configured to hook the removing tool. According to this configuration, a wiring harness assembling operation can be easily performed since the dummy plug 30 can be easily pulled out even if it is erroneously inserted into the cavity 11.

Figure 4:
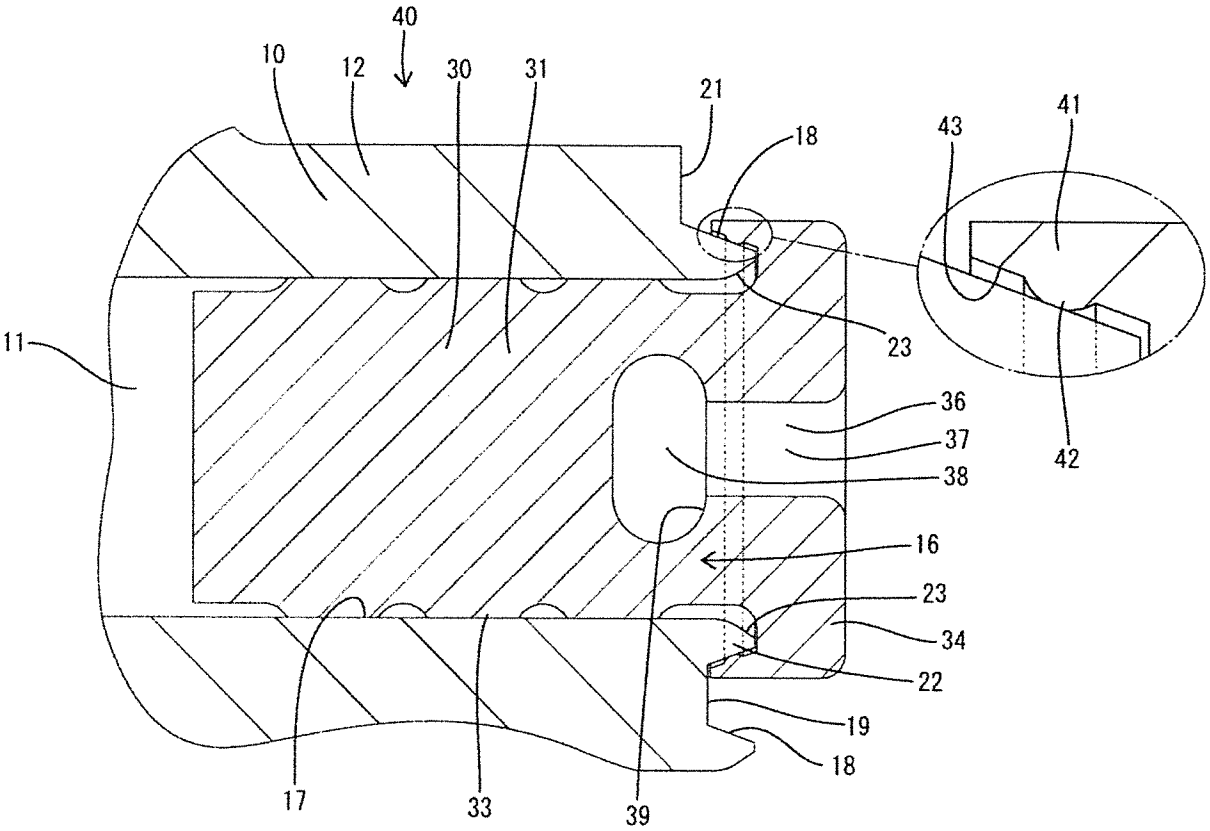
FIG. 4 is a partial enlarged section showing a dummy plug fit into a waterproof connector in a second embodiment.

A waterproof connector 40 according to a second specific embodiment of the present invention is described with reference to FIG. 4.

The fluid- or waterproof connector 40 of this second embodiment differs from the first embodiment in that a pressing portion 41 includes at least one pressing projection 42 to be held in contact with a tapered surface 18. Note that the same or similar components as those of the first embodiment are denoted by the same reference signs and not repeatedly described.

Similar to the first embodiment, the waterproof connector 40 in this second embodiment is configured such that tapered surfaces 18 are formed on the rear surface of a housing 10 to surround one or more openings 16 of one or more cavities 11 and a dummy plug 30 is provided with the pressing portion 41 to be pressed against the tapered surface 18 and a hook portion 36 configured to hook a removing tool. As in the first embodiment, the pressing portion 41 is provided to project forward on a radial outer end part of a jaw portion 34 provided on a rear side of a main body 31.

An inclined surface 43 inclined with respect to a front-back direction is provided on a radially inner side of the pressing portion 41. The inclined surface 43 is inclined radially outwardly toward the front. The inclined surface 43 is formed on the entire inner peripheral surface of the pressing portion 41. The inclined surface 43 is inclined at a substantially constant gradient (substantially equal to that of the tapered surface 18) over the entire circumference of the pressing portion 41.

The pressing projection 42 projects on an inner side of the pressing portion 41. The pressing projection 42 is located in an intermediate position (particularly substantially in a center) of the inclined surface 43 in the front-back direction. The pressing projection 42 is continuously formed over the entire circumference of the pressing portion 41. The pressing projection 42 projects from the inclined surface 43 while having a substantially semicircular cross-section.

When the dummy plug 30 of this second embodiment is pushed forward into the cavity 11 through the opening 16, the pressing projection 42 of the pressing portion 41 is held proximate to the tapered surface 18. If the fluid- or waterproof connector 40 is placed in an environment to be subjected to a high fluid or water pressure (such as during high-pressure washing) and the high water pressure acts on the rear surface of the dummy plug 30, the pressing projection 42 is pressed against the tapered surface 18 to be resiliently squeezed and held in close contact with the tapered surface 18, thereby preventing water intrusion through between the pressing portion 41 and the tapered surface 18.

As described above, in this second embodiment, the tapered surface 18 is formed on the rear surface of the housing 10 to substantially surround the opening 16 of the cavity 11 and the dummy plug 30 is provided with the pressing portion 41 to be pressed against the tapered surface 18. Thus, as in the first embodiment, a forward movement of the dummy plug 30 is limited by the pressing portion 41 of the dummy plug 30 being pressed against the tapered surface 18, with the result that the dummy plug 30 can be prevented from being pushed toward a back side of the cavity 11.

Further, since the pressing portion 41 includes the pressing projection 42 to be held in contact with the tapered surface 18, a fluid or water intrusion path can be closed by the pressing projection 42 being squeezed and held in close contact with the tapered surface 18.

The invention is not limited to the above described and illustrated first and second embodiments. For example, the following embodiments also are included in the scope of the invention.

Although the tapered surface 18 is continuous over the entire circumference along the opening 16 of the cavity 11 in the above first and second embodiments, there is no limitation to this and tapered surfaces may be intermittently formed to partially surround an opening of a cavity.

Although the pressing portion 32, 41 is continuously formed over the entire circumference of the jaw portion 34 in the above first and second embodiments, there is no limitation to this and the pressing portion may be partially formed on the jaw portion in the circumferential direction.

Although the pressing portion 32, 41 includes the pressing surface 35 or the pressing projection 42 in the above first and second embodiments, there is no limitation to this and the pressing portion may have any shape if it can be pressed against the tapered surface.

Although the wide portion 38 of the hook portion 36 expands outward from the hole portion 37 over substantially the entire circumference in the above first and second embodiments, there is no limitation to this and a part of the wide portion of the hook portion in the circumferential direction may expand outward from the hole portion.

Although the pressing surface 35 is formed on the entire inner surface of the pressing portion 32 in the above first embodiment, there is no limitation to this and the pressing surface may be formed on a part of the inner surface of the pressing portion.

Although the pressing projection 42 is in the center of the inclined surface 43 in the front-back direction in the above second embodiment, there is no limitation to this and the pressing projection may be provided at a position of the inclined surface near the front or rear end in the front-back direction or a plurality of pressing projections may be provided side by side in the front-back direction.

REFERENCE SIGNS

C, 40 . . . waterproof connector
T . . . terminal fitting
10 . . . housing
11 . . . cavity
16 . . . opening of cavity
17 . . . sealing surface (inner surface of cavity)
18 . . . tapered surface
30 . . . dummy plug
32, 41 . . . pressing portion
35 . . . pressing surface
36 . . . hook
42 . . . pressing projection

What is claimed is:

1. A fluidproof connector, comprising:

a housing with opposite front and rear ends and rearwardly open cavities configured for at least partly accommodating terminal fittings, outwardly facing tapered surfaces formed on the rear end of the housing to surround openings of the respective cavities and inclined to come closer to an inner surface of the cavity toward the rear end; and at least one dummy plug configured to be held in close contact with the inner surface of the cavity by being at least partly inserted into the cavity in an insertion direction, the dummy plug having a pressing portion configured to be pressed against the tapered surface by a forward force acting on the dummy plug.

2. The fluidproof connector of claim 1, wherein the pressing portion includes a pressing surface to be held in surface contact with the tapered surface.

3. The fluidproof connector of claim 1, wherein the pressing portion includes at least one pressing projection to be held in contact with the tapered surface.

4. The fluidproof connector of claim 1, wherein the dummy plug includes a hook configured to hook a removing tool.

5. The fluidproof connector of claim 1, wherein the dummy plug includes a main body configured to be accommodated in the cavity and having an outer shape substantially in conformity with a cross-sectional shape of a sealing surface of the cavity.

6. The fluidproof connector of claim 1, wherein the dummy plug includes one or more lips on an outer peripheral surface thereof to interact with a sealing surface of the cavity.

7. The fluidproof connector of claim 1, wherein the pressing portion is provided on a jaw at a rear end of the dummy plug.

8. The fluidproof connector of claim 7, wherein the jaw projects farther out radially than the main body.

9. The fluidproof connector of claim 7, wherein the jaw continuously projects from the main body over substantially an entire circumference of the main body.

* * * * *